United States Patent [19]

Fink

[11] 4,372,449

[45] Feb. 8, 1983

[54] AUXILIARY TOWEL RACK

[75] Inventor: Raymond W. Fink, Maple Heights, Ohio

[73] Assignee: Tool Dynamics, Inc., Bedford Heights, Ohio

[21] Appl. No.: 106,757

[22] Filed: Dec. 26, 1979

[51] Int. Cl.[3] ..... A47F 5/01

[52] U.S. Cl. ..... 211/86; 211/106; 248/214

[58] Field of Search ..... 211/86, 87, 106, 104; 248/214

[56] References Cited

U.S. PATENT DOCUMENTS

| | | | |
|---|---|---|---|
| 1,334,032 | 3/1920 | Holwick | 211/86 |
| 2,295,736 | 9/1942 | Jernson | 211/104 |
| 2,313,245 | 3/1943 | Kent | 211/104 |

FOREIGN PATENT DOCUMENTS

| | | | |
|---|---|---|---|
| 214807 | 10/1909 | Fed. Rep. of Germany | 211/86 |
| 78371 | 4/1951 | Norway | 21/106 |

*Primary Examiner*—Roy D. Frazier
*Assistant Examiner*—Robert W. Gibson, Jr.
*Attorney, Agent, or Firm*—Porter & Associates Co.

[57] ABSTRACT

A lightweight, portable, auxiliary towel rack adapted for use with an existing towel bar includes spaced legs uniquely configured such that the towel rack is securely held in place on the towel bar. Each leg includes a first straight section at one end of which a reversely bent portion having a second straight section is provided. A straight third section extends from the reversely bent portion, the third straight section being substantially at right angles to the first straight section. A short wall-engaging portion extends from the third straight section in a direction generally parallel to the first straight section. The legs are connected to the underside of an oval member having a major dimension approximately equal to that of conventional towel bars. In use, the reversely bent portions of the legs are wrapped about the towel bar and the wall-engaging portions engage the wall. The weight of the oval member, the weight of the first straight sections of the legs, and the weight of any articles which may be placed on the rack serve to pivot the rack about the towel bar and force the wall-engaging portions into firm engagement with the wall. The oval member lies in a plane positioned approximately 45° below the horizontal, this angle of inclination and the reversely bent portions combining to advantageously load the towel bar and prevent the auxiliary towel rack from shifting position.

4 Claims, 3 Drawing Figures

AUXILIARY TOWEL RACK

CROSS-REFERENCE TO RELATED APPLICATION

Auxiliary towel rack design, design patent application, Ser. No. 106,756, filed concurrently.

BACKGROUND OF THE INVENTION

1. Field of the Invention

The invention relates to auxiliary towel racks adapted to be used with existing, stationary towel bars, and, more particularly, to an auxiliary towel rack exceedingly simple in construction and having improved wall-engaging and towel bar-engaging qualties.

2. Description of the Prior Art

Various types of auxiliary racks, particularly towel racks, already are known. These auxiliary towel racks are adapted to be used with stationary, horizontally extending towel bars commonly found in bathrooms, laundry rooms, kitchens, and so forth.

Typical prior auxiliary towel racks are made of metal rod up to 0.25 inch in diameter. The racks typically include hooked portions by which the rack can be hung on the towel bar. In most instances, the racks include a portion engageable with the wall so that an object-receiving portion of the rack will project outwardly of the towel bar.

Although these prior devices function adequately to support towels or other objects, they have had certain drawbacks which have made their widespread use impractical. Generally, the prior devices are large and quite bulky and include numerous bends and welded joints. Not only do the racks occupy a substantial space, but they also are expensive to manufacture. Removal and storage of prior racks is made difficult because of their bulkiness. Moreover, the hooked portions of the racks can present difficulties in handling and in storage.

One known rack overcomes some of the foregoing difficulties by providing a platform-like rack from which a pair of spaced legs depend. The spaced legs are connected by an interconnecting, elongate portion. The legs are placed behind an existing towel bar and the weight of the rack, as well as objects placed on the rack, tends to bias the interconnecting portion into firm engagement with the wall. Although this device is thought to be an improvement over other towel rack configurations, certain difficulties still remain. The relationship of the interconnecting portion, the legs, and the platform to each other is such that the towel bar is loaded improperly. That is, the towel bar is loaded in tension with respect to the wall so that if a weak towel bar/wall mounting is provided, the towel bar may be pulled from the wall. Another concern is that removal of objects from the rack may tend to dislodge the rack from the towel bar. In order to alleviate this problem, the prior rack in question provided towel bar-engaging members in an attempt to prevent excessive movement of the towel rack. The towel bar-engaging members added undesirably to the complexity and expense of the assembly.

SUMMARY OF THE INVENTION

The present invention provides a new and improved auxiliary towel rack which overcomes the foregoing concerns of prior art auxiliary towel racks. Essentially, the invention comprises elongate sections having a length approximately equal to the width of an average conventional towel bar and positioned in use parallel to an existing towel bar. In preferred form, the elongate sections are connected at their ends by rounded portions; taken together, the elongate sections and the rounded end portions define an oval member. The oval member is suspended outwardly of the towel bar and lies in a plane inclined approximately 45° downwardly from the horizontal.

The oval member is supported by a pair of spaced legs. Each leg comprises a first straight section which is fixed to the underside of the oval member. A reversely bent portion having a second straight section extends from the first straight section and a third straight section extends from the reversely bent portion at approximately a 90° angle to the first straight section. A short, wall-engaging portion projects from the end of the third straight section in a direction generally parallel with that of the first straight section.

By the foregoing construction, the reversely bent portion is wrapped about the towel bar and the wall-engaging portions are positioned substantially perpendicular to the wall. The weight of the oval member and the first straight sections, combined with the weight of objects placed on the oval member, tends to rotate the rack about the towel bar such that the wall-engaging members firmly engage the wall to thereby prevent shifting of the rack with respect to the towel bar. The reversely bent portions also assist in preventing shifting of the rack when objects are removed from the rack. Further, the inclination of the oval member with respect to the horizontal and the configuration of the legs is such that the towel bar tends to be loaded in shear, rather than in tension. This lessens the chance that the towel bar will be pulled from the wall. The configuration of the assembled towel rack is such that no hooks are provided, and the entire structure is succeedingly simple and lightweight. It can be handled without difficulty and stored readily. These advantages and a fuller understanding of the present invention may be had by referring to the following description and claims, taken in conjunction with the accompanying drawings.

DESCRIPTION OF THE PREFERRED EMBODIMENT

Figure 1:
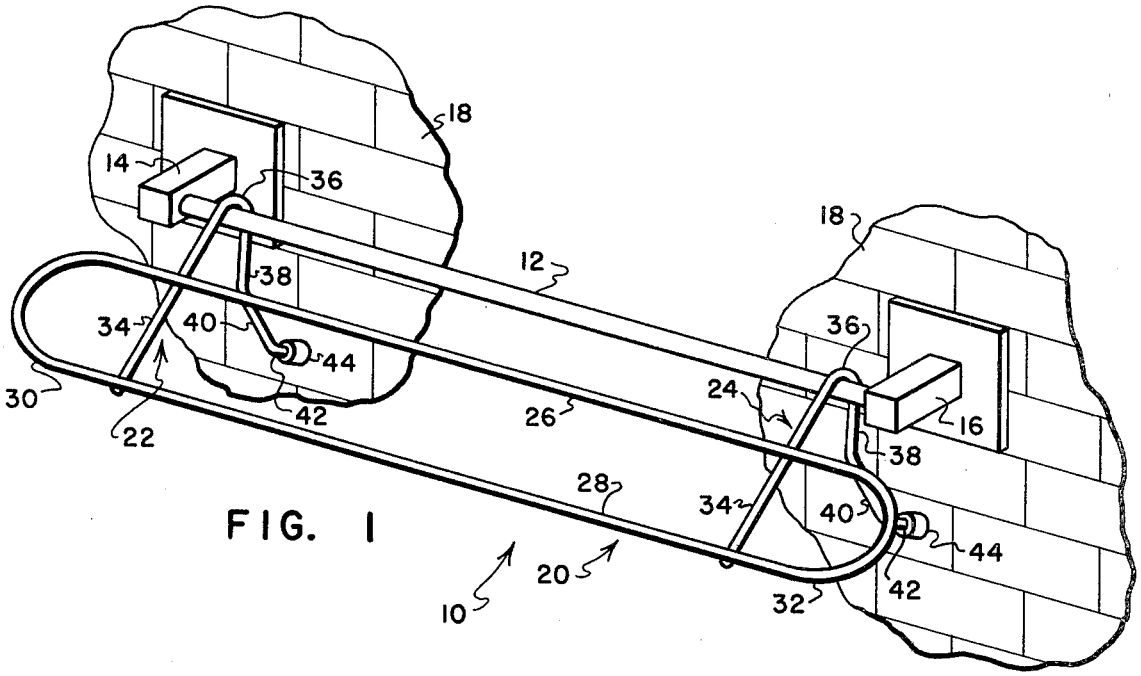
FIG. 1 is a perspective view of an auxiliary towel rack according to the invention used in conjunction with an existing towel bar.

Referring to FIG. 1, an auxiliary towel rack 10 is shown as it might be used with an elongate, horizontal towel bar 12. The towel bar 12 includes mounts 14, 16 by which the towel bar 12 is attached to a wall 18.

The auxiliary towel rack 10 is formed entirely of steel rod approximately 0.020 inch in diameter. The elements of the towel rack 10 can be welded or otherwise attached to each other to form the final assembly. In order to enhance the appearance and longevity of the towel rack 10, the towel rack 10 either can be chrome plated or painted. Suitable welding, plating, and painting techniques are well known in the art and do not form a part of the present invention.

The towel rack 10 includes three elements: an oval member 20 positioned parallel to the towel bar 12, and spaced legs 22, 24. The oval member 20 includes spaced elongate sections 26, 28 having rounded ends 30, 32. The length of the elongate sections 26, 28 is selected such that the member 20 is approximately the length of an average conventional towel bar.

Figure 2:
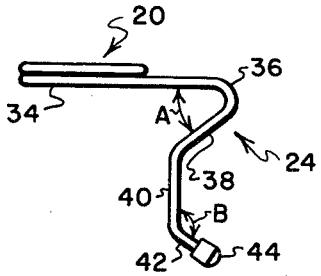
FIG. 2 is a side elevational view of the auxiliary towel rack of FIG. 1.
Figure 3:
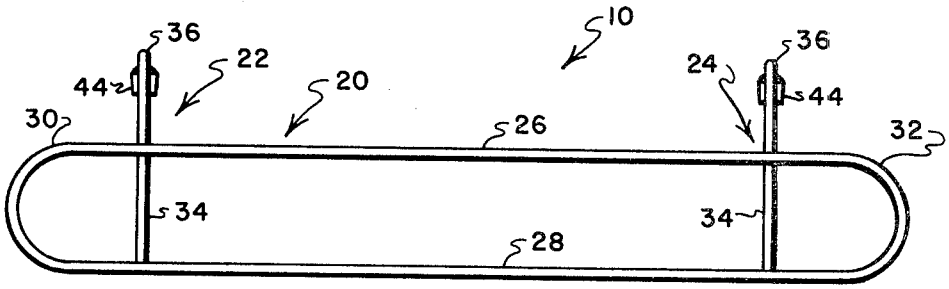
FIG. 3 is a plan view of the auxiliary towel rack of FIG. 1.

The legs 22, 24 are identical and include a first straight section 34 which is affixed to the underside of the oval member 20 at spaced locations. A reversely bent portion 36 extends from one end of the first straight section 34 and includes a second straight section 38. The straight sections 34, 38 are separated by an angle A as indicated in FIG. 2. Angle A for most purposes will be on the order of 35°. The reversely bent portion 36 provides a smooth interconnection between the sections 34, 38.

A third straight section 40 extends from the section 38 and is positioned substantially at right angles to the section 34. A short, wall-engaging portion 42 is connected to the section 40 and extends in a direction generally parallel with the first straight section 34. The wall-engaging portion 42 extends from the section 40 at an angle B as illustrated in FIG. 2. For most installations, angle B is approximately 125°. The portion 42 is provided with a resilient cap 44 in order to prevent damage to the wall 18 and in order increase frictional contact with the wall 18.

It has been found that most towel bars are spaced approximately 3.5 inches from a wall. With a towel bar 12 spaced such a distance from the wall 18, the oval member 20 will lie in a plane positioned approximately 45° downwardly from the horizontal. In this position, the foreshortened distance between the elongate sections 26, 28 and the bar 12 will provide a fairly equal spacing between the sections 26, 28 and the bar 12.

In operation, when the auxiliary towel rack 10 is positioned about a towel bar 12, the weight of the oval member 20, the first straight sections 34, as well as the weight of any objects which may be placed on the member 20 tend to pivot the rack 10 about the towel rack 12. Because the wall-engaging portions 42 are positioned approximately perpendicular to the wall 18, the pivoting action of the rack 10 about the bar 12 will tend to urge the caps 44 firmly into engagement with the wall 18. The towel bar 12 will be loaded in shear, more than in tension, so that the chances of the mounts 14, 16 being pulled from the wall 18 will be diminished. Moreover, the interaction between the wall-engaging portions 42 and the wall 18, as well as the interaction between the straight sections 38 and the underside of the towel bar 12 tend to restrain the towel rack 10 from being moved when an object is added to, or removed from, the oval member 20.

It will be apparent from the foregoing description that a towel rack according to the invention provides an exceedingly simple, lightweight structure which can be handled conveniently and stored without difficulty. The invention provides a considerable object-supporting area without excessive bulk or complexity. The use of hooks or towel bar-engaging members is avoided entirely.

Although the invention has been described with a certain degree of particularity, it will be understood that the present disclosure of the present embodiment has been made only by way of example and that various changes and modifications may be made by those skilled in the art without departing from the true spirit and scope of the invention. Accordingly, it is intended that the patent shall cover, by suitable expression in the appended claims, whatever features of patentable novelty exist in the invention disclosed.

What is claimed is:

1. An auxiliary towel rack for use with a stationary, horizontally disposed towel bar positioned a fixed distance from a wall, comprising:

(a) a member having at least two elongate sections positioned substantially parallel to the towel bar, the elongate sections lying in a plane positioned at approximately a 45° angle downwardly from the horizontal, the elongate sections located at horizontal elevation at or below that of the towel bar; and (b) at least two spaced legs connected to the elongate sections and extending between the towel bar and the wall, each leg including:

(i) a first straight section connected to the rack;

(ii) a reversely bent portion extending from one end of the first straight section, the reversely bent portion including a second straight section and a rounded interconnecting portion connecting the first and second straight sections, the first and second straight sections being spaced at approximately a 35° angle;

(iii) a third straight section extending from the second straight section, the third straight section being positioned at approximately at a right angle with respect to the first straight section; and, (iv) a short, wall-engaging portion, the wall-engaging portion being connected to the third straight section and extending from the third straight section at such an angle that, in use, the wall-engaging portion is positioned approximately perpendicular to the wall.

2. The auxiliary towel rack of claim 1, wherein the elements of the auxiliary towel rack are formed of metal rod.

3. An auxiliary towel rack adapted for use with a stationary, horizontally extending towel bar, comprising:

(a) at least one elongate section positioned outwardly of the existing towel bar and maintained substantially parallel to the existing bar, the elongate section located at a horizontal elevation at or below that of the towel bar;

(b) a pair of spaced legs connected to the elongate section, the spaced legs including a reversely bent portion engageable with the towel bar, the reversely bent portion including a straight section positioned at approximately a 35° angle with respect to that portion of leg in contact with the elongate section, the remainder of the reversely bent portion smoothly interconnecting the straight section and that portion of the leg in contact with the elongate section;

(c) a wall-engaging portion included as part of each leg, the wall-engaging portion being positioned approximately perpendicular to the wall; and (d) a section included as part of each leg connecting the reversely bent portion and the wall-engaging portion.

4. An auxiliary towel rack adapted for use with a stationary, horizontally extending towel bar, comprising:

(a) at least one elongate section positioned outwardly of the existing towel bar and maintained substantially parallel to the existing bar, the elongate section located at a horizontal elevation at or below that of the towel bar;

(b) a pair of spaced legs connected to the elongate section, the spaced legs including a reversely bent portion engageable with the towel bar;

(c) a wall-engaging portion included as part of each leg, the wall-engaging portion being positioned approximately perpendicular to the wall; and (d) a section included as part of each leg connecting the reversely bent portion and the wall-engaging portion, the section being positioned at approximately a right angle with respect to that portion of the leg in contact with elongate section.

* * * * *